427-428 SR
2/11/86 OR 4,569,864

United States Patent [19]
McIntyre

[11] Patent Number: 4,569,864
[45] Date of Patent: Feb. 11, 1986

[54] ROLL COATING APPLICATOR AND ADHESIVE COATINGS AND THE LIKE AND PROCESS OF COATING

[75] Inventor: Frederic S. McIntyre, Wellesley, Mass.

[73] Assignee: Acumeter Laboratories, Inc., Marlborough, Mass.

[21] Appl. No.: 509,320

[22] Filed: Jun. 30, 1983

[51] Int. Cl.[4] ..... B05D 1/28
[52] U.S. Cl. ..... 427/428; 118/204; 118/249; 118/262; 118/674; 118/679; 427/207.1; 427/256
[58] Field of Search ..... 118/204, 249, 262, 674, 118/679; 427/428, 207.1, 256

[56] References Cited

U.S. PATENT DOCUMENTS

| | | | |
|---|---|---|---|
| T941,013 | 12/1975 | Huffaker et al. | 118/262 |
| 2,293,690 | 8/1942 | Harrigan | 427/428 |
| 2,956,905 | 10/1960 | Jones et al. | 118/674 |
| 3,018,757 | 1/1962 | Loppnow | 118/262 |
| 3,402,695 | 9/1968 | Baker et al. | 118/674 |
| 3,595,204 | 4/1971 | McIntyre | 118/8 |
| 4,367,693 | 1/1983 | Ogihara et al. | 118/674 |
| 4,378,390 | 3/1983 | Yoshida et al. | 118/262 |

FOREIGN PATENT DOCUMENTS 0751865 7/1980 U.S.S.R. ..... 118/674

OTHER PUBLICATIONS

"Extruder Valve", Acumeter Laboratories, 1977 Bulletin.
"Wide Band Extrusion Nozzles", Acumeter Laboratories, 1982 Bulletin.

*Primary Examiner*—Norman Morgenstern
*Assistant Examiner*—Janyce A. Bell
*Attorney, Agent, or Firm*—Rines and Rines Shapiro and Shapiro

[57] ABSTRACT

A roll coating applicator and method for applying a coating fluid to a moving web which includes applying coating fluid through a nozzle to a rotating roll, positioning one or more rolls in coating fluid engaging contact with each other and at least one of which is in coating fluid engaging contact with the first roll, rotating the second roll at a greater rotational speed than the first roll and positioning a portion of a moving web in coating fluid engaging contact with the second or subsequent roll.

32 Claims, 2 Drawing Figures

Figure 1:
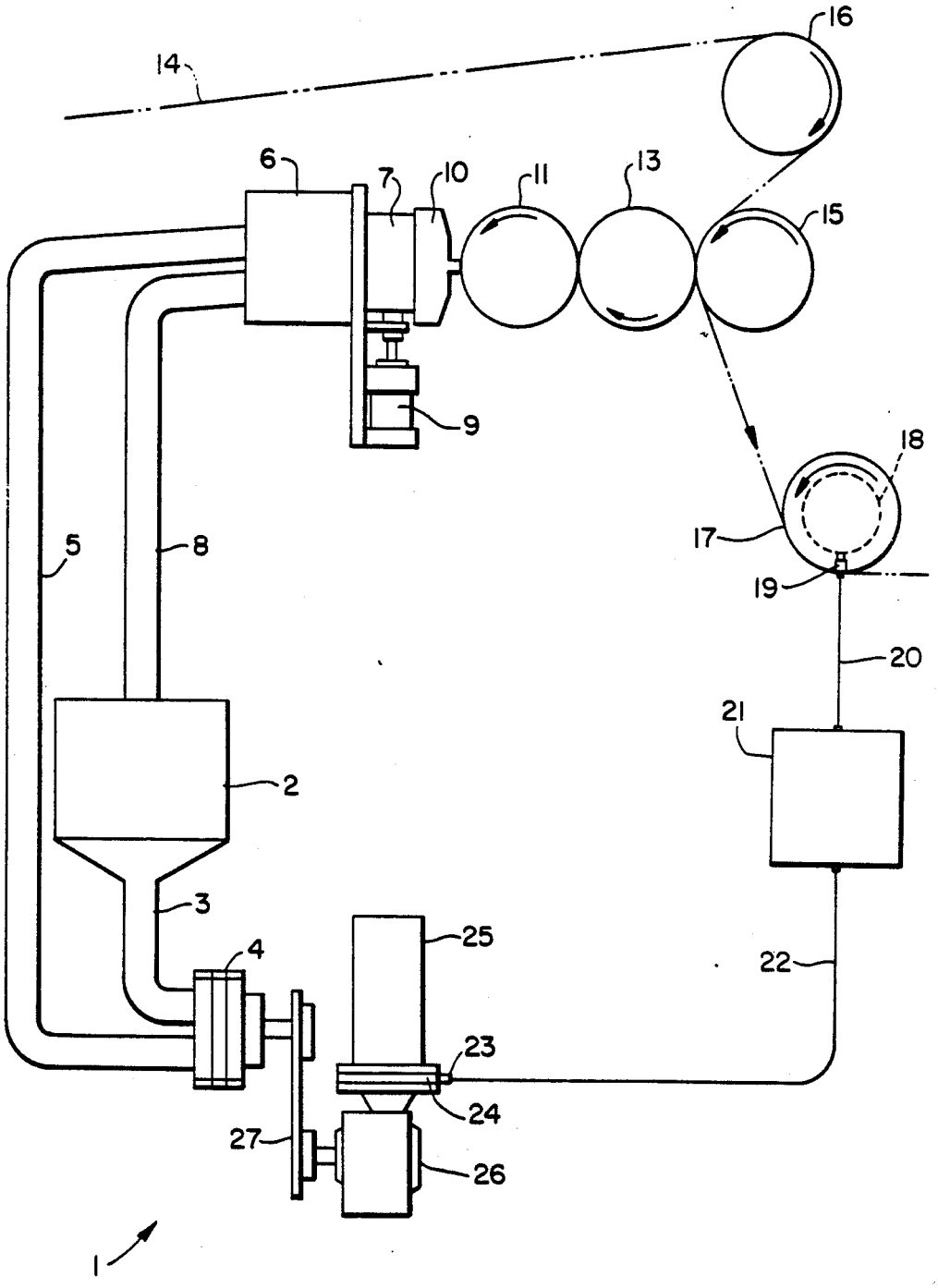

ROLL COATING APPLICATOR AND ADHESIVE COATINGS AND THE LIKE AND PROCESS OF COATING

The present invention relates to a process and apparatus for applying coating fluids and the like to a moving web of material. More specifically, the invention is in one important application concerned with processes and apparatus for depositing a uniform thickness coat of an adhesive or other coating fluid to a surface of a web of material.

In the art of depositing fluid on a moving web it is well known to use a roll-coating apparatus. Conventional roll applicating devices normally contain an open trough with a partially submerged pick-up roll. The trough contains fluid which is transferred to the pick-up roll, as the roll rotates. A blade device (often called a "doctor" blade) which is mounted close to the pick-up roll, removes the excessive coating fluid from the pick-up roll. A series of adjacent and intersecting rolls transfers a coating of fluid progressively across the roll surfaces. The web of material to be coated passes between and in contact with one of the rolls adjacent to the pick-up roll and a non-coated laminating roll. In this manner fluid is transferred from the coated roll to the moving web.

Another well known roll coating apparatus does not require the fluid trough, but instead utilizes a remote fluid supply. Coating fluid is pumped from the remote fluid supply to a section of a pair of moving rolls near their intersection point. The quantity of fluid delivered approximates coating synchronously with web speed. In some embodiments, special gates or fins are placed near the point of intersection of the two rolls, forming a "V" shaped cross-sectional area which prevents the coating fluid from flowing over the entire surface of the rolls. Then, one or more adjacent and intersecting rolls transfers a coating of fluid progressively across the roll surfaces and into contact with a moving web as discussed above.

In both of the aforementioned embodiments, the intersecting rolls of each pair are rotating in opposite directions such that the surface friction generated by this mechanical action causes an increase in temperature to both the fluid and the roll surfaces. As the machine continues to operate, the temperature will continue to rise, depending upon the relative speeds and fluid viscosity. This results in a change in fluid transfer from roll to roll, with respect to time, causing the coating fluid applied to the moving web of material to increase in coating thickness or coating weight with time. Present day roll coating apparatus now often incorporate a water chill system which passes through one of the middle rolls. The thermal conductance of the cycled water removes the excess generated heat, resulting in stabilized coating fluid viscosities for a given set of steady state operating conditions. However, the water chill system (for example, when used in a silicone coating process) is not designed for start and stop modes, but is only effective when operating at a fixed speed. Rapid changes in process speed will change the roll temperatures, as noted above, faster than the water chill system can react. Therefore, a coating fluid temperature change occurs which changes coating weight, resulting in a non-uniformly coated surface.

The present invention, on the other hand, provides for a novel method of and apparatus for applying a constant thickness or coating weight of fluid to a moving web irrespective of the changing speed of the web or the viscosity of the coating fluid.

Accordingly, it is an object of the present invention to provide a new and improved method and apparatus that, as above stated, shall not be subject to the above described disadvantages and limitations but that, to the contrary, enables the application of a constant thickness or constant weight of fluid to a moving web of material irrespective of the changing speed of the web.

Another object is to provide such a novel method and apparatus that is adapted to apply a constant thickness or constant weight of coating fluid upon a surface of a moving web of material irrespective of the viscosity of the coating fluid.

A further object is to provide for novel application of a coating fluid to a moving web at a preselected temperature to obtain improved coating integrity and smoothness.

These and still further objects will become apparent hereinafter and are more fully delineated in the appended claims.

From one of its important viewpoints the invention embraces, in summary, a roll coating applicator apparatus for applying fluid to a moving web, having, in combination, a coating nozzle for discharging a coating fluid at a predetermined rate; a nozzle roll in close spacial proximity to the coating nozzle for receiving the discharged coating fluid from the coating nozzle; an applicating roll disposed in close spacial relationship to the nozzle roll and adapted to receive coating fluid from the nozzle roll; guide means adapted to guide a moving web into coating fluid-engaging contact with the applicating roll to allow coating fluid on the applicating roll to be transferred to the moving web; and drive means adapted to drive the nozzle roll at a proportionally lower rotational speed than the applicating roll. Preferred details and best mode embodiment features are hereinafter presented.

Figure 2:
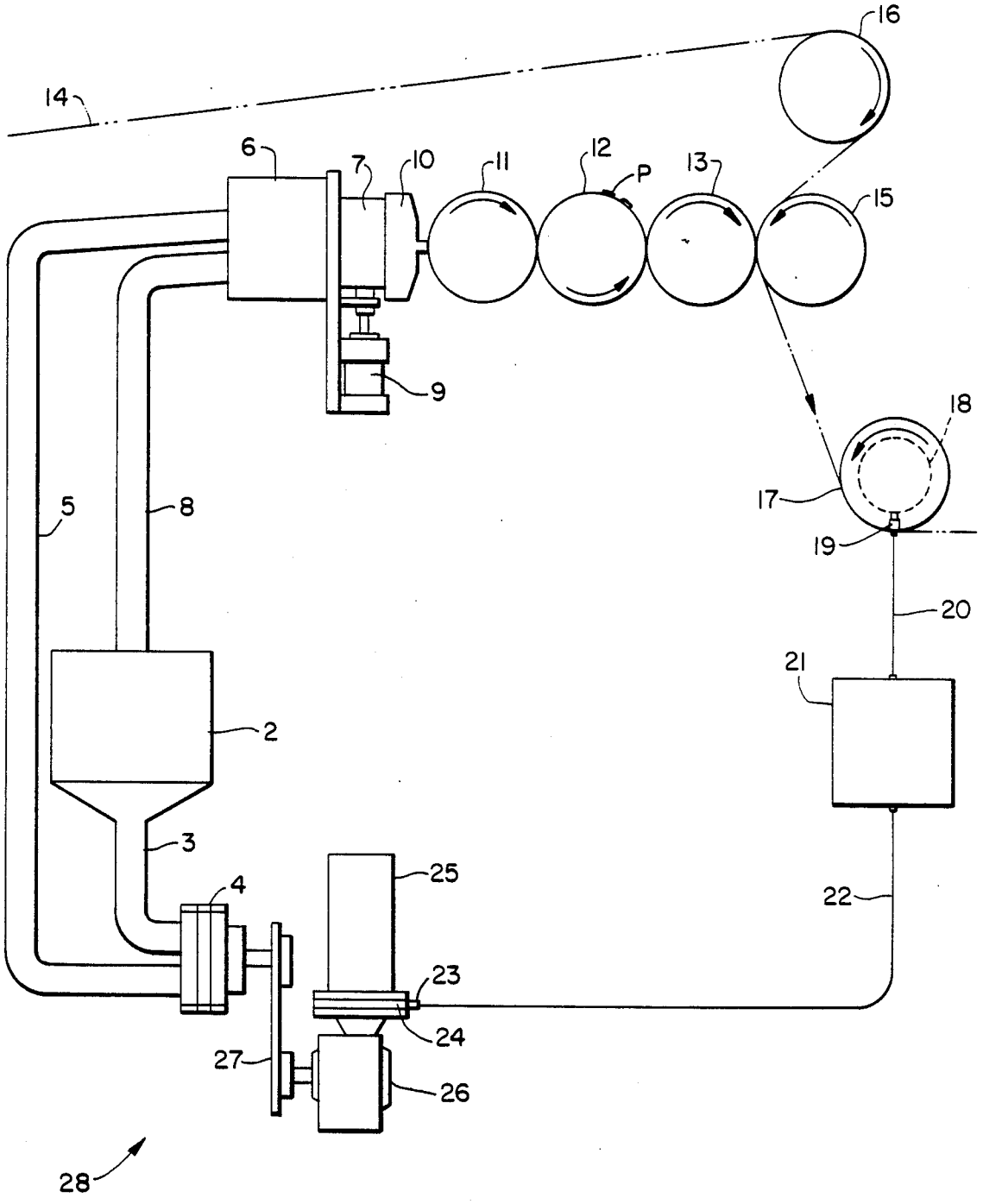

The machine will now be described in connection with the appended drawings, in which:

FIG. 1 is a side elevation view of a two-roll roll coating applicator constructed in accordance with a preferred embodiment of the invention; and FIG. 2 is a side elevation view of a modified three-roll roll coating applicator.

In FIG. 1, a two-roll roll coating applicator is shown at 1 for applying fluid to a moving web surface 14, and constructed in accordance with the invention. A supply of liquid adhesive or other coating fluid is stored in a holding tank 2 and conveyed through a conduit 3 to a metering pump 4 which forces the fluid through a supply conduit 5 into a porting block 6. The porting block 6 acts as a standard fluid supply inlet and has fluid connections to a valve 7 and a return conduit 8. The porting block 6 is used to provide a common adapter to connect the supply conduit 5 and the return conduit 8 to the valve 7. The valve 7 may be of any appropriate well-known construction, such as an extruder valve assembly of the type described in a 1977 bulletin entitled "Extruder Valve" of Acumeter Laboratories, the assignee of the present application, or a poppet valve assembly.

The valve 7 serves as a gate mechanism to direct fluid either to a coating nozzle 10 or the return conduit 8. The return conduit 8 is fluidly connected to the holding tank 2 in order to direct fluid that is not supplied to the coating nozzle 10 back to the holding tank 2. Since some radiation curable coatings are sensitive to light energy and humidity, the fluid delivery system comprising the holding tank 2, conduit 3, metering pump 4, supply conduit 5, porting block 6, valve 7, return conduit 8 and coating nozzle 10 is constructed as a sealed system. Light energy and excessive humidity are therefore prevented from contacting the coating fluid until it has been expelled from the nozzle 10.

The coating nozzle 10 can be of any conventional type designed to deliver fluid from a source to a moving surface. An acceptable fluid coating nozzle of this type is described in a 1982 bulletin entitled "Wide Band Extrusion Nozzles" of said Acumeter Laboratories and in U.S. Pat. No. 3,595,204.

The valve 7 is actively switched between a supply position applying the coating fluid to the nozzle 10 and a return position exiting fluid to the conduit 8, and vice versa, by a switching pump such as an air pump 9. Compressed air is delivered to the valve 7 to provide the motive force needed to re-direct the valving mechanism to change the fluid direction flow position of the valve 7. The air pump 9 would be connected to the air inlet ports (not shown) of the valve 7 in accordance with the customary operating procedure of the type of valve being used. Such an air inlet port arrangement is shown, for example, in the "Extruder Valve" bulletin described previously.

The coating nozzle 10 may be of any type capable of directing fluid flow from the valve 7 to a moving surface, being preferably of longitudinal extrusion slot configuration (into the drawing sheet in FIG. 1) parallel to the longitudinal surface of the roll 11 in close spacial proximity to the nozzle. An acceptable fluid coating nozzle, for example, is described in a 1982 bulletin entitled "Wide Band Extrusion Nozzles" of said Acumeter Laboratories, or a bead type extrusion nozzle as shown in the bulletin "Extruder Valve" previously noted, or as described in said Letters Patent.

For the two-roller roll coating form of applicator shown in FIG. 1, coating fluid is directed from the coating nozzle 10 to a nozzle roll 11 as of steel. The nozzle roll 11 rotates in a counter-clockwise direction as shown by the arrow, and fluidly engages an applicating roll 13, as of urethane plastic or the like, in such a manner as to transfer coating fluid from the nozzle roll 11 to the applicating roll 13, in a manner later described in more detail. The applicating roll 13 contacts a moving web 14 and is kept in fluid-engaging contact with the web 14 by a back-up roll 15, also as of steel or the like. The direction of movement of the moving web 14 and the rolls 13 and 15 is shown by the arrows in FIG. 1. The applicating roll 13 and the back-up roll 15 have a rotational speed at, or approximately at, the line speed of the moving web 14 and in a direction such that the tangential movement of the surfaces of the rolls that are in contact with the web 14 is in the same direction as that portion of the web 14 that is in contact with the rolls, as particularly shown both in FIGS. 1 and 2. Therefore, since the rotational speeds of the rolls 13 and 15 are at the line speed of the moving web 14, no slippage occurs between the rolls 13 and 15 and the web 14.

Returning to the fluid delivery system, the metering pump 4 is synchronously driven at a speed proportional to the speed of the moving web 14, as later further described. As the web speed is increased, the fluid displacement from the metering pump 4 increases, passing more fluid through the supply conduit 5 and the porting block 6 and into the valve 7, thus making more coating fluid available to the coating nozzle 10.

The nozzle roll 11 and the applicating roll 13 are both driven, for example by a motor (not shown), in opposite rotational directions (as indicated by arrows in FIGS. 1 and 2) and in a manner to allow the nozzle roll 11 to rotate at a proportionally lower rotational speed than the applicating roll 13. When coating fluid is placed on the nozzle roll 11 by the proximal nozzle 10, therefore, the relative movement and fluid engagement between the nozzle roll 11 and the closely spaced applicating roll 13 causes coating fluid to be transferred to the applicating roll 13. Since the applicating roll 13 is rotating at a higher rotational speed than the nozzle roll 11, the coating fluid or a portion thereof is sheared onto the surface of the applicating roll 13. Also, since the relative proportional speed of the nozzle roll 11 and the applicating roll 13 is variable, a uniform smooth coating of preselected thickness can be transferred to the applicating roll 13. Additionally, the gap between the coating nozzle 10 and the nozzle roll 11 is made adjustable such that when operating at greater proportional roll speed ratios, which permit slower surface speeds of the nozzle roll 11 relative to the speed of the moving web 14 (with the fluid displacement from the metering pump 4 being directly proportional to the web speed), a proportionally heavier coat weight of fluid is extruded from the coating nozzle 10 onto the proximal nozzle roll 11. In this situation, the gap between the coating nozzle 10 and the nozzle roll 11 may be increased to allow for the thicker coating or heavier coating weight of fluid to be evenly and smoothly distributed over the nozzle roll 11. In contrast, if the proportional ratio between the nozzle roll 11 and the coating roll 13 is decreased, the nozzle gap must also be reduced, so as to maintain a constant thickness of coating fluid on the nozzle roll 11 and the applicating roll 13.

The applicating roll 13 may be rotated at a proportional speed less than the speed of the moving web 14. This speed difference allows coating fluid on the applicating roll (or a portion thereof) to be sheared on to a surface of the moving web 14 and creates a smooth uniform coat of fluid on the moving web 14. Typically, the applicating roll 13 is rotated at minus 10% of the web line speed.

In some circumstances, such as when the moving web 14 is composed of extensible films or stretchable materials, it is desirable actively to drive the moving web 14 past the applicating roll 13 to reduce linear deformation of the web. When actively driving the moving web 14, the normally free spinning back-up roll 15 may be driven, as by a motor (not shown), at a speed equal to or slightly higher than the line speed of the moving web 14. Since the act of shearing the coating fluid upon the moving web 14 by the proportionally slower rotational speed of the applicating roll 13 may cause sufficient friction on the extensible film to stretch and distort the moving web, the laminating roll is driven in frictional engagement and in the same direction and speed as the moving web 14, as shown by the arrows in FIGS. 1 and 2. The friction between the moving web 14 and the driven back-up roll 15 compensates for the distorting forces acting on the moving web 14 by the slower moving applicating roll 13 and provides a uniformly and smoothly coated web without reducing the desired shear effect from the applicating roll 13 to the moving web 14.

The moving web 14 is guided between the applicating roll 13 and the back-up roll 15 by an idler guide roll 16. After the web 14 has been coated, it is guided away from the applicating roll 13 and the back-up roll 15 by a timing roll 17. The timing roll 17 is a free-spinning roll that is kept in frictional engagement with the moving web 14 and therefore rotates at, or approximately at, the line speed of the moving web 14.

The timing roll 17 is provided with a web speed indicator, which includes a timing gear 18 and a rotational speed sensor. One or more reference points, such as teeth on the periphery of the timing gear 18, rotate at a speed directly proportional to the speed of rotation of the outer surface of the timing roll 17. The teeth of the timing gear 18 may be magnetic, typically ferromagnetic, such that a sensing means, such as a reference magnetic pick-up 19 located near the timing gear 18, can be adapted to sense when the magnetic reference points (teeth) are at their closest approach to the sensor. By noting the number of times a reference point (magnetic tooth) passes the magnetic pick-up sensor 19 per unit time, the speed of the timing roll 17 and therefore the speed of the moving web 14 can be determined.

The magnetic pick-up 19 is shown electrically connected by conductor 20 to a digital speed controller 21 which is also electrically connected, as by conductor 22, to a second magnetic pick-up 23. The second magnetic pick-up 23 senses the movement of a timing gear 24 that is connected to a motor 25, in the same manner as described above, to determine the operating speed of the motor 25. The digital speed controller 21 therefore senses the speed of the moving web 14 and the speed of the motor 25 and is adapted to control the motor 25 speed and cause the motor 25 to operate at a speed directly proportional to the line speed of the moving web 14.

The motor 25 is mechanically connected to a speed reduction means, such as a gear box 26 to step-down the speed of the motor 25. A power transmission system, such as a belt drive 27, mechanically connects the gear box 26 with the metering pump 4 such that the motor 19 provides a driving force for the metering pump 4. A chain and sprocket system may be used as one form of belt drive power transmission system.

Since the digital speed controller 21 regulates the speed of the motor 25, based on the line speed of the moving web 14, and the motor 25 drives the metering pump 4, the metering pump 4 is synchronously driven at a speed proportional to web speed, and the amount of fluid made available for dispersion by the coating nozzle 10 is also directly proportional to the line speed of the moving web 14.

Referring now to FIG. 2, a different roller arrangement is used for the three-roller roll coater generally designated by the number 28. Other than as stated below, the three-roll roll coater 28 functions in a similar manner as the two-roll roll coater 1, previously described, with like numerals designating like components.

In the operation of a three roller roll coater 28, the coating nozzle 10 distributes coating fluid upon a steel or similar nozzle roll 11 as previously described. The nozzle roll 11 fluidly engages a urethane or similar transfer roll 12, and both are driven in well-known fashion, for example, by a motor (not shown), in opposite rotational directions (as shown by arrows in FIG. 2) and in a manner to allow the nozzle roll 11 to rotate at a proportionally lower rotational speed than the transfer roll 12. The relative speed difference between the nozzle roll 11 and the transfer roll 12 allows coating fluid to be sheared onto the transfer roll 12 and provides for a uniform smooth coat of fluid on the transfer roll 12.

The transfer roll 12 is in fluid-engaging contact with the steel or similar applicating roll 13 such that coating fluid is transferred from the transfer roll 12 to the applicating roll 13. The applicating roll 13 is also conventionally driven, for example, by a further motor (not shown), at a speed equal to or slightly greater than, and in an opposite rotational direction to the transfer roll 12, as shown by the arrows in FIG. 2. When the applicating roll 13 is rotated at a speed greater than the rotational speed of the transfer roll 12, coating fluid is sheared from the transfer roll 12 upon the applicating roll 13 which provides a uniform smooth coat of fluid on the applicating roll 13. Coating fluid may then be directly applied or sheared on to a moving web 14 as disclosed above.

The three-roller roll coater 28 can also be adapted to provide shaped patterns of coating fluid on the moving web 14. In one embodiment, as an illustration, the transfer roll 12 may be provided with a non-uniform roll surface. Typically this roll will contain raised surface patterns P equivalent to the shape of the pattern of coating fluid to be applied to the moving web 14. Patterns such as squares, triangles and circles are typical. Only the raised surfaces on the transfer roll 12 fluidly contact the nozzle roll 11 and, therefore, only the preselected pattern of coating fluid is transferred from the nozzle roll 11 to the transfer roll 12. Since only a preselected pattern of coating fluid is on the transfer roll 12, only that pattern of coating fluid is transferred to the applicating roll 13 and therefrom to the moving web 14. When shaped patterns of coating fluid are applied to the moving web 14, as described above, the applicating roll 13 is normally driven at a rotational speed proportionally equal to the line speed of the moving web 14. This equalization of speeds avoids shearing the fluid upon the moving web 14 and therefore retains the integrity of the shaped pattern.

Both the two-roll roll coating applicator 1 and the three-roll roll coating applicator 28 have means for adjusting the distance between each of the respective rolls, including the back-up roll 15. The same, or a similar means can be used to adjust the distance between the nozzle 10 and the nozzle roll 11. Any reasonable method or apparatus is acceptable so long as the rolls 11–15 can be independently positioned respective to each other and the nozzle 10. One adjusting means includes a series of hydraulic or air pistons connected to the axles of the rolls 11–15. Additionally a pair of adjustable stops are positioned on the opposite side of the roll axles from the pistons. By manually adjusting the positions for the stops and then activating the pistons to drive the axles of the rolls 11–15 against their respective stops, the respective distance between the nozzle 10 and the nozzle 11 and the distance between the rolls 11–15 is controlled.

It should be noted that not all of the rolls 11–15 need an independent piston and stop arrangement. For some applications it is sufficient to actively push certain rolls against fixed position rolls. Additionally, it is contemplated that certain rolls will be held in contact with an adjacent roll at more than a single line of contact. Specifically, it may be desirable in some circumstances, for example, to increase the fluid transfer rate between rolls, to force a steel roll (such as the nozzle roll 11) into contact with the urethane plastic or similar roll (such as the applicating roll 13 in FIG. 1) such that the distance between the centers of the two rolls is less than their combined respective radii. In this situation, the steel roll is pushed into the urethane plastic roll, creating a concavity in the surface of the urethane plastic roll.

For a two-roller roll coating system using a silicone coating fluid, a 2 gram per square meter (2 micron thickness) coating weight application of fluid to a moving web requires that the speed ratio between the applicating roll and the nozzle roll be approximately 30 to 1. This means that the applicating roll makes 30 revolutions for each 1 revolution of the nozzle roll. Additionally the applicating roll would normally operate at a surface web speed of approximately −10% of actual web speed (i.e. the tangential velocity of the surface of the applicating roll in contact with the moving web is 10% less than, but in the same direction as, the velocity of the moving web), so as properly to shear the coating fluid onto the moving web.

For a two-roller roll coating system using a silicone coating fluid, a 1 gram per square meter (1 micron thickness) coating weight application of fluid to a moving web requires that the speed ratio between the applicating roll and the nozzle roll be approximately 45 to 1. To adjust from the above example, the metering pump displacement is reduced to meet the specification for 1 gram per square meter.

In both examples, the nozzle gap between the coating nozzle and the nozzle roll is kept at approximately 25 to 50 microns. The coating nozzle-to-nozzle roll gap need not be changed to effect a change in coating weights. When applying lower coat weights, the nozzle roll is simply operated at a slower surface speed than that required for a heavier coating weight. The change in ratio from 30 to 1 to a 45 to 1 ratio, for example, has been noted in the examples above.

Other useful coatings include: water-based emulsions, laquers, varnishes, primers, solvent-based coatings, coating rubber and toluene curable coatings, such as electron beam (EB) and ultraviolet (UV) curable materials, and hot melt thermoplastic materials, including adhesives, and similar materials.

While the invention has been explained in connection with a preferred construction and mode of operation, it should be understood that modifications will also occur to those skilled in this art, and such are considered to fall within the spirit and scope of the invention as defined in the appended claims.

What is claimed is:

1. A roll coating applicator apparatus for applying fluid to a moving web, having, in combination, a coating nozzle for discharging a coating fluid at a predetermined rate; a nozzle roll disposed in close spacial proximity to the coating nozzle for receiving the discharged coating fluid from the coating nozzle; an applicating roll disposed in close spacial relationship to the nozzle roll and adapted to receive coating fluid from the nozzle roll; guide means adapted to guide a moving web into coating fluid-engaging contact with the applicating roll to allow coating fluid on the applicating roll to be transferred to the moving web; and drive means driving the nozzle roll at a proportionally lower rotational speed than the applicating roll, the speed difference between the nozzle roll and the applicating roll being sufficient to cause coating fluid on the nozzle roll to be sheared onto the applicating roll and thereby to control the thickness of the coating transferred to the applicating roll and ultimately to the moving web.

2. A roll coating applicator as claimed in claim 1, in which means is provided for adjusting the rate that coating fluid is discharged from the coating nozzle to be made substantially proportional to the speed of the moving web.

3. A roll coating applicator as claimed in claim 1, in which means is provided for adjusting the spacial distance between the coating nozzle and the nozzle roll in relation to the proportional speed ratio between the nozzle roll and the applicating roll.

4. A roll coating applicator as claimed in claim 1, and in which the drive means rotates the nozzle roll and the applicating roll in opposite rotational directions.

5. A roll coating applicator as claimed in claim 1, and in which a transfer roll is provided positioned essentially between and in close spacial relationship to the nozzle roll and the applicating roll and adapted to receive coating fluid from the nozzle roll and to transfer coating fluid to the applicating roll.

6. A roll coating applicator as claimed in claim 5, and in which the transfer roll is provided with a non-uniform roll surface to allow only a preselected pattern of coating fluid to be transferred from the nozzle roll to the applicating roll.

7. A roll coating applicator as claimed in claim 6, and in which the non-uniform roll surface is provided with raised patterns equivalent to the shape of the pattern of coating fluid to be applied to the moving web.

8. A roll coating applicator as claimed in claim 7, and in which the drive means rotates the nozzle roll at a proportionally lower rotational speed than the transfer roll.

9. A roll coating applicator as claimed in claim 8, and in which the drive means rotates the nozzle roll and the applicating roll in the same rotational direction and the transfer roll in the opposite rotational direction.

10. A roll coating applicator as claimed in claim 1 and in which the coating nozzle is shaped to discharge the coating fluid longitudinally along the surface of the nozzle roll.

11. A roll coating applicator apparatus for applying fluid to a moving web, having, in combination, a fluid source adapted to contain a supply of coating fluid; a supply conduit connected to the fluid source and adapted to direct coating fluid away from the fluid source; a fluid pump connected to the supply conduit and adapted to create a preselected rate of coating fluid flow through the supply conduit; a coating nozzle for discharging the coating fluid at a predetermined rate; a fluid directing assembly connected to the supply conduit and the coating nozzle for directing coating fluid from the supply conduit to the coating nozzle or away from the coating nozzle; a return conduit connected to the fluid directing assembly for directing the coating fluid that is not directed to the coating nozzle away from the coating nozzle; a nozzle roll disposed in close spacial proximity to the coating nozzle for receiving the discharged coating fluid from the coating nozzle; an applicating roll adapted to receive coating fluid from the nozzle roll; a back-up roll disposed in close spacial relationship to the applicating roll; a guide roll adapted to guide a moving web between the applicating and the back-up roll and into contact with both the applicating roll and the back-up roll to allow coating fluid on the applicating roll to be transferred to the moving web; drive means driving the nozzle roll at a proportionally lower rotational speed than the applicating roll, the speed difference between the nozzle roll and the applicating roll being sufficient to cause coating fluid on the nozzle roll to be sheared onto the applicating roll and thereby to control the thickness of the coating transferred to the applicating roll and ultimately to the moving web; sensing means disposed to sense the speed of the moving web; and control means connected to the sensing means and the fluid pump for causing the fluid pump to create a coating fluid flow through the supply conduit at a rate proportional to the speed of the moving web.

12. A roll coating applicator as claimed in claim 11 and in which a transfer roll is provided positioned essentially between and in close spacial relationship to the nozzle roll and the applicating roll and adapted to receive coating fluid from the nozzle roll and to transfer coating fluid to the applicating roll.

13. A roll coating applicator as claimed in claim 12 and in which the transfer roll is provided with a non-uniform roll surface to allow only a preselected pattern of coating fluid to be transferred from the nozzle roll to the applicating roll.

14. A roll coating applicator as claimed in claim 13 and in which the non-uniform roll surface includes raised patterns equivalent to the shape of the pattern of coating fluid to be applied to the moving web.

15. A roll coating applicator as claimed in claim 14 and in which means is provided for driving the applicating roll at a rotational speed substantially equal to the speed of the moving web.

16. A roll coating applicator as claimed in claim 11 and in which the sensing means includes a free spinning roll in frictional contact with the moving web, a reference point on the free-spinning roll and a sensor in close spacial relationship to the free-spinning roll adapted to sense when the reference point is at its closest approach to the sensor.

17. A roll coating applicator as claimed in claim 16 and in which the reference point is magnetic and the sensor is a reference magnetic pickup.

18. A roll coating applicator as claimed in claim 11 and in which the return conduit is connected to the fluid source to allow the coating fluid that is not directed to the coating nozzle to be directed to the supply of coating fluid in the holding tank.

19. A roll coating applicator as claimed in claim 11 and in which means is provided for driving the applicating roll at a rotational speed proportionally higher than the speed of the moving web.

20. A roll coating applicator as claimed in claim 11, and in which the control means comprises a digital motor drive.

21. A process for applying fluid to a moving web which comprises applying a coating fluid to a first rotating roll, providing a further roll or a plurality of further rolls in coating fluid engaging contact with one another, one roll of which is in coating fluid engaging contact with the first roll, rotating said one roll at a greater rotational speed than the first roll, the speed difference between said one roll and said first roll being sufficient to cause coating fluid on said first roll to be sheared onto said one roll and thereby to control the thickness of the coating transferred to said one roll and ultimately to a moving web, and positioning a portion of the moving web in coating fluid-engaging contact with said one roll or a subsequent roll such that the direction of movement of the contacting portion of the moving web is in essentially the same direction and speed as the contacted roll.

22. A process as claimed in claim 21, and in which the first roll and said one roll are rotated in opposite rotational directions.

23. A process as claimed in claim 21 and in which the said applying of the coating fluid is effected longitudinally along the surface of the first rotating roll.

24. A process for applying fluid to a moving surface which comprises extruding a longitudinally extending line of viscous coating fluid on to a longitudinally extending rotating surface, transferring the viscous coating fluid from the longitudinally extending rotating surface to the moving surface to be coated, and adjusting the relative speed between the longitudinally extending rotating surface and the moving surface to be coated so that the relative speed is sufficient to cause the viscous coating fluid to be sheared on to the moving surface to be coated and to control the thickness of the coating on the moving surface.

25. A process as claimed in claim 24, and in which the rotational speed of the longitudinally extending rotating surface is less than the speed of the moving surface to be coated.

26. A process as claimed in claim 24, and which further includes adjusting the distance between the longitudinally extending rotating surface and the moving surface to be coated.

27. A process as claimed in claim 24, and in which the moving surface to be coated is a second longitudinally extending rotating surface.

28. A process for applying various coating weights of a constant viscosity coating fluid to a moving surface which comprises applying the coating fluid to a rotating roll, positioning the moving surface to be coated in fluid engaging contact with the rotating roll, adjusting the distance between the rotating roll and the moving surface to be coated in proportion to the viscosity of the fluid, and adjusting the relative speed between the moving surface to be coated and the rotating roll so that the relative speed is sufficient to cause the coating fluid to be sheared on to the moving surface to be coated in coating weights of fluid proportioned to the relative speed between the moving surface and the rotating roll and thereby to control the thickness of the coating on the moving surface.

29. A process as claimed in claim 28, and in which the distance between the rotating roll and the moving surface to be coated is increased in direct proportion to an increase in the viscosity of the coating fluid to be used.

30. A process as claimed in claim 28, and in which the relative speed between the rotating roll and the surface to be coated is increased to produce a lower coating weight of fluid on the surface to be coated.

31. A process as claimed in claim 28, and in which the relative speed between the rotating roll and the surface to be coated is decreased to produce a higher coating weight of fluid on the surface to be coated.

32. A process as claimed in claim 28, and in which the surface to be coated is moving in the same direction as the tangential direction of the portion of the rotating roll in closest proximity to the surface to be coated.

* * * * *